US005229249A

United States Patent [19]

Katoh et al.

[11] Patent Number: 5,229,249

[45] Date of Patent: Jul. 20, 1993

[54] SILVER HALIDE PHOTOGRAPHIC MATERIAL AND METHOD FOR PROCESSING THE SAME

[75] Inventors: Kazunobu Katoh; Tetsuro Kojima, both of Kanagawa, Japan

[73] Assignee: Fuji Photo Film Co., Ltd., Kanagawa, Japan

[21] Appl. No.: 755,426

[22] Filed: Sep. 4, 1991

[30] Foreign Application Priority Data

Sep. 4, 1990 [JP] Japan ..... 2-233698

[51] Int. Cl.[5] ..... G03C 1/06

[52] U.S. Cl. ..... 430/264; 430/434; 430/598; 430/449; 430/267

[58] Field of Search ..... 430/264, 598, 517, 434, 430/449, 267

[56] References Cited

U.S. PATENT DOCUMENTS 4,851,321 7/1989 Takagi et al. ..... 430/264

*Primary Examiner*—Charles L. Bower, Jr.
*Assistant Examiner*—Geraldine Letscher
*Attorney, Agent, or Firm*—Sughrue, Mion, Zinn, Macpeak & Seas

[57] ABSTRACT

A silver halide photographic material comprising a support, having thereon one or more hydrophilic colloid layers, wherein at least one of the hydrophilic colloid layers is a silver halide emulsion layer, and wherein the silver halide emulsion layer or another hydrophilic colloid layer contains a compound represented by general formula (I):

$$Y-[(X)_n-A_0-B_0]_m \quad (I)$$

wherein Y represents a group which is adsorbed on silver halide, X represents a divalent group comprising an atom or group of atoms selected from among a hydrogen atom, a carbon atom, a nitrogen atom, an oxygen atom and a sulfur atom, $A_0$ represents a divalent linking group which has at least two alkyleneoxy units, $B_0$ represents an amino group, an ammonium group or a nitrogen containing heterocyclic group, m represents 1, 2 or 3, and n represents 0 or 1, as well as a method for processing a silver halide photographic material in the presence of a compound according to general formula (I).

14 Claims, No Drawings

SILVER HALIDE PHOTOGRAPHIC MATERIAL AND METHOD FOR PROCESSING THE SAME

FIELD OF THE INVENTION

The present invention .concerns silver halide photographic materials and a method of forming superhigh contrast negative images with those materials. In particular, it concerns silver halide photographic materials which are used in photomechanical processes and a method for the manufacture of superhigh contrast negative images in which these materials are used.

BACKGROUND OF THE INVENTION

Image forming systems which exhibit superhigh contrast photographic characteristics (for example with a gamma value of at least 10) are required for improving the reproduction of continuous tones by means of screen dot images and for improving the reproduction of line images in the graphic arts field.

Conventionally, special developers known as lith developers have been used for this purpose. Lith developers contain only hydroquinones as the developing agent. The sulfite which is used as a preservative is in the form of an adduct with formaldehyde. The free sulfite ion concentration is very low (generally not more than 0.1 mol/liter) so as not to interfere with the infectious development. Consequently, the lith developers are very susceptible to aerial oxidation and they have a major disadvantage in that they cannot be stored for more than 3 days.

The methods in which hydrazine derivatives are used, disclosed, for example, in U.S. Pat. Nos. 4,224,401, 4,168,977, 4,166,742, 4,311,781, 4,272,606, 4,211,857 and 4,243,739 are known as methods by which high contrast photographic characteristics can be obtained using stable developers. Photographic characteristics of high speed and superhigh contrast can be obtained using these methods. The addition of high concentrations of sulfite to the developer can be tolerated and consequently, the stability of the developer against aerial oxidation is greatly improved in comparison to that of a lith developer.

However, the above mentioned image forming systems require developers which have a very high pH value and so the developers are susceptible to aerial oxidation. Denaturation of the fixer is likely to occur as a result of the admixture of the developer with the fixer and there is the further disadvantage that there is a heavy burden of neutralization when scrapping used processing liquids.

Progress has been made in the past with nucleation development accelerators to realize high contrast development with developers of a lower pH. The methods in which secondary and tertiary amino compounds are added to the developer as disclosed in the aforementioned literature references, the methods in which amino compounds such as those disclosed in JP-A-63-511, JP-A-63-604, JP-A-63-1124 and JP-A-63-124045 are added to the light-sensitive layer and the methods in which amino compounds such as those disclosed in JP-A-2-170155 are added to the light-sensitive layer, are already known (The term "JP-A" as used herein signifies an "unexamined published Japanese patent application".) However, none of these methods provides a truly satisfactory high contrast, and often they must be used in large quantities. Therefore. the development of a more effective accelerator is clearly desirable.

SUMMARY OF THE INVENTION

An object of the present invention is to provide a light-sensitive material for making printing plates which gives an image of high $D_{max}$ with high contrast in a stable developer.

Another object of the present invention is to provide a light-sensitive material for making printing plates which contains an effective accelerator, a small quantity of which has the effect of increasing contrast and accelerating action.

A further object of the present invention is to provide a light-sensitive material for making printing plates which gives a high contrast image in a developer of low pH.

These and other objects of the present invention have been realized by developing a light-exposed silver halide photographic material comprising one or more hydrophilic colloid layers, at least one of the hydrophlic colloid layers being a silver halide emulsion layer, in the presence of a compound represented by general formula (I):

$$Y—[(X)_n—A_0—B_0]_m \quad (I)$$

wherein Y represents a group which is adsorbed on silver halide; X represents a divalent group comprising an atom or group of atoms selected from among a hydrogen atom, a carbon atom, a nitrogen atom, an oxygen atom and a sulfur atom; $A_0$ represents a divalent linking group which has at least two alkyleneoxy units; $B_0$ represents an amino group, an ammonium group or a nitrogen-containing heterocyclic group; m represents 1, 2 or 3; and n represents 0 or 1.

DETAILED DESCRIPTION OF THE INVENTION

The group which is adsorbed on silver halide and is by Y in general formula (I) is a nitrogen-represented containing heterocyclic compound, a heterocyclic mercapto compound or an aliphatic mercapto compound for example.

When Y represents a nitrogen-containing heterocyclic compound or a heterocyclic mercapto compound, the compound of general formula (I) can be represented by general formula (III) or (IV), respectively.

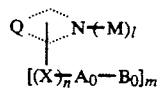

(III)

$$MS—Z—[(X)_n—A_0—B_0]_m \quad (IV)$$

In general formula (III), l represents 0 or 1, $—[(X)_n—A_0—B_0]_m$ has the same meaning as in general formula (I), and Q represents a five- or six-membered heterocyclic ring which is constructed with at least one type of atom selected from among carbon, nitrogen, oxygen and sulfur atoms. Furthermore, this heterocyclic ring may be condensed with a carboaromatic ring or a heteroaromatic ring.

The heterocyclic ring represented by Q may be, for example, a substituted or unsubstituted indazole, benzimidazole, benzotriazole, benzoxazole, benzothiazole, imidazole, thiazole, oxazole, triazole, tetrazole, azaindene, pyrazole, indole, triazine, pyrimidine, pyridine or quinoline.

M represents a hydrogen atom, an alkali metal atom (for example, sodium, potassium), an ammonium group (for example, trimethylammonium, dimethylbenzylammonium) or a group which can becomes a hydrogen atom or an alkali metal atom under alkaline conditions (for example, acetyl, cyanoethyl, methanesulfonylethyl).

Furthermore, these heterocyclic groups may be substituted with nitro groups, halogen atoms (for example, chlorine, bromine), mercapto groups, cyano groups, substituted and unsubstituted alkyl groups (for example, methyl, ethyl, propyl, tert-butyl, cyanoethyl, methoxyethyl, methylthioethyl), aryl groups (phenyl, 4-methanesulfonamidophenyl, 4-methylphenyl, 3,4-dichlorophenyl, naphthyl), alkenyl groups (for example, allyl), aralkyl groups (for example, benzyl, 4-methylbenzyl, phenethyl), alkoxy groups (for example methoxy, ethoxy), aryloxy groups (for example phenoxy, 4-methoxyphenoxy), alkylthio groups (for example methylthio, ethylthio, methoxyethylthio), arylthio groups (for example, phenylthio), sulfonyl groups (for example, methanesulfonyl, ethanesulfonyl, p-toluenesulfonyl), carbamoyl groups (for example, unsubstituted carbamoyl, methylcarbamoyl, phenylcarbamoyl), sulfamoyl groups (for example, unsubstituted sulfamoyl, methylsulfamoyl, phenylsulfamoyl), carboxamido groups (for example, acetamido, benzamido), sulfonamido groups (for example, methanesulfonamido, benzenesulfonamido, p-toluenesulfonamido), acyloxy groups (for example, acetyloxy, benzoyloxy), sulfonyloxy groups (for example, methanesulfonyloxy), ureido groups (for example, unsubstituted ureido, methylureido, ethylureido, phenylureido), thioureido groups (for example, unsubstituted thioureido, methylthioureido), acyl groups (for example, acetyl, benzoyl), heterocyclic groups (for example, 1-morpholino, 1-piperidino, 2-pyridyl, 4-pyridyl, 2-thienyl, 1-pyrazolyl, 1-imidazolyl, 2-tetrahydrofuryl, tetrahydrothienyl), oxycarbonyl groups (for example, methoxycarbonyl, phenoxycarbonyl), oxycarbonylamino groups (for example, methoxycarbonylamino, phenoxycarbonylamino, 2-ethylhexyloxycarbonylamino), amino groups (for example, unsubstituted amino, dimethylamino, methoxyethylamino, anilino), carboxylic acid and salts thereof, sulfonic acid and salts thereof, and hydroxy groups.

When Y represents an aliphatic mercapto compound, the compound includes alkyl mercapto compounds (e.g., a mercapto methyl group, a mercapto ethyl group, a mercapto hexyl group, etc.).

The divalent linking group represented by X may be, for example, —S—, —O—,

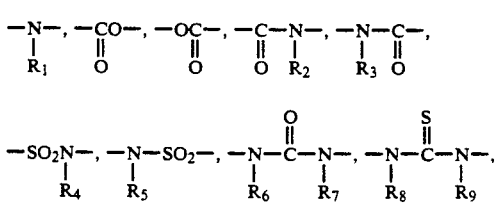

-continued

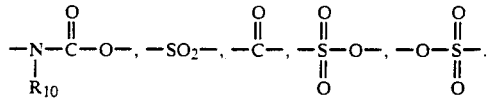

These linking groups may be bonded to a linear chain or branched alkylene group (for example, methylene, ethylene, propylene, butylene, hexylene, 1-methylethylene) between the linking group as indicated above and Q in general formula (III). $R_1$, $R_2$, $R_3$, $R_4$, $R_5$, $R_6$, $R_7$, $R_8$, $R_9$ and $R_{10}$ represent hydrogen atoms, substituted or unsubstituted alkyl groups having 1 to 20, preferably 1 to 12 carbon atoms (for example, methyl, ethyl, propyl, n-butyl), substituted or unsubstituted aryl groups having 6 to 20, preferably 6 to 12 carbon atoms (for example, phenyl, 2-methylphenyl), substituted or unsubstituted alkenyl groups having 2 to 20, preferably 2 to 12 carbon atoms (for example, propenyl, 1-methylvinyl), or substituted or unsubstituted aralkyl groups having 7 to 20, preferably 7 to 12 carbon atoms (for example, benzyl, phenethyl). As substituent groups for $R_1$ to $R_{10}$, the substituent groups cited in connection with the heterocyclic groups represented by Q can be used.

$A_0$ represents a divalent linking group which has at least two alkylene units, and it preferably represents

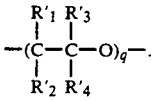

$R'_1$, $R'_2$, $R'_3$ and $R'_4$ each represents a hydrogen atom or an alkyl group which has from 1 to 4 carbon atoms (for example, methyl, ethyl, n-propyl, n-butyl), and q represents an integer of from 2 to 50.

$B_0$ is a substituted or unsubstituted amino group which can be represented by the general formula (V):

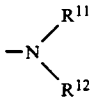

(V)

In this formula, $R^{11}$ and $R^{12}$ may be the same or different, and each represents a hydrogen atom, a substituted or unsubstituted alkyl group which has from 1 to 30 carbon atoms, an alkenyl group which has from 2 to 20 carbon atoms or an aralkyl group which has from 7 to 20 carbon atoms, and these groups may be linear chain groups (for example methyl, ethyl, n-propyl, n-butyl, n-octyl, allyl, 3-butenyl, benzyl, 1-naphthylmethyl), branched groups (for example, iso-propyl, tert-octyl) or cyclic groups (for example, cyclohexyl).

Furthermore, $R^{11}$ and $R^{12}$ may be joined together to form a ring. They may be cyclized to form a saturated heterocyclic ring which contains one or more hetero atoms (for example, oxygen, sulfur, nitrogen). Such a ring may be, for example, a pyrrolidyl ring, a piperidyl ring or a morpholino ring. Furthermore, examples of the substituent groups for $R^{11}$ and $R^{12}$ include carboxyl group, sulfo group, cyano group, halogen atoms (for example, fluorine, chlorine, bromine), hydroxy group, alkoxycarbonyl groups which have not more than 20 carbon atoms (for example, methoxycarbonyl, ethoxycarbonyl, benzyloxycarbonyl), aryloxycarbonyl groups which have not more than 20 carbon atoms (for example, phenoxycarbonyl), alkyloxy groups which have not more than 20 carbon atoms (for example, methoxy, ethoxy, benzyloxy, phenethyloxy), single ring aryloxy groups which have not more than 20 carbon atoms (for example, phenoxy, p-tolyloxy), acyloxy groups which have not more than 20 carbon atoms (for example, acetyloxy, propionyloxy), acyl groups which have not more than 20 carbon atoms (for example, acetyl, propionyl, benzoyl, mesyl), carbamoyl groups (for example, carbamoyl, N,N-dimethylcarbamoyl, morpholinocarbonyl, piperidinocarbonyl), sulfamoyl groups (for example, sulfamoyl, N,N-dimethylsulfamoyl, morpholinosulfonyl, piperidinosulfonyl), acylamino groups which have not more than 20 carbon atoms (for example, acetylamino, propionylamino, benzoylamino, mesylamino), sulfonamido groups (for example, ethylsulfonamido, p-toluenesulfonamido), carboxamido groups which have not more than 20 carbon atoms (for example, methylcarboxamido, phenylcarboxamido), ureido groups which have not more than 20 carbon atoms (for example, methylureido, phenylureido), and amino groups (the same as those of general formula (V)).

The ammonium groups of $B_0$ are represented by general formula (VI).

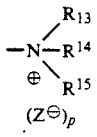

(VI)

In this formula, $R^{13}$, $R^{14}$ and $R^{15}$ represent the same groups as $R^{11}$ and $R^{12}$ in general formula (VI) described above. $Z^{\ominus}$ represents an anion, for example a halide ion (for example, $Cl^{\ominus}$, $Br^{\ominus}$, $I^{\ominus}$), a sulfonate ion (for example, trifluoromethanesulfonate, p-toluenesulfonate, benzenesulfonate, p-chlorobenzenesulfonate), a sulfate ion (for example, ethylsulfate, methylsulfate), perchlorate or tetrafluoroborate. Moreover, p represents 0 or 1, and it is 0 when the compound forms an intramolecular salt.

The nitrogen containing heterocyclic rings of $B_0$ are five- or six-membered rings which contain at least one nitrogen atom. These rings may have substituent groups such as the substituent groups cited in connection with the heterocyclic groups represented by Q, and they may be condensed with other rings such as a carboaromatic ring and a heteroaromatic ring. Examples of the nitrogen containing heterocyclic rings include imidazolyl groups, pyridyl groups and thiazolyl groups.

Preferred compounds represented by general formula (III) can be represented by general formulae (VII), (VIII) and (IX) indicated below:

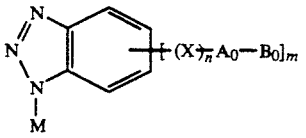

(VII)

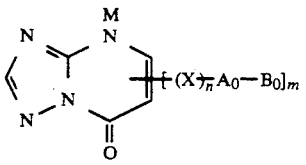

(VIII)

-continued

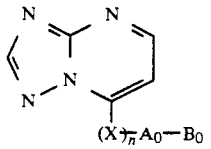

(IX)

In these formulae, $-(X)_n-A_0$, $-B_0$, M and m have the same meaning as do those terms in the aforementioned general formula (I).

General formula (IV) is described in detail below.

Z represents a heterocyclic ring comprised of carbon, nitrogen, oxygen, sulfur and selenium atoms.

The heterocyclic rings represented by Z are preferably five- or six-membered rings which may be condensed with carboaromatic rings or heteroaromatic rings.

Tetrazole, triazole, thiadiazole, oxadiazole, selenazole, imidazole, thiazole, oxazole, benzimidazole, benzthiazole, benzoxazole, benzoselenazole, tetra-azaindene, triazaindene and penta-azaindene rings are preferred as the aromatic ring. Of these, the tetrazole and thiadiazole rings are the most desirable. These heterocyclic rings may be substituted with the substituent groups cited for Q in general formula (III).

Furthermore, M and $-[(X)_n-A_0-B_0]_m$ have the same meaning as in general formula (III).

Examples of compounds represented by general formula (I), (III) or (IV) are indicated below, but the present invention is not limited to these examples.

(1)

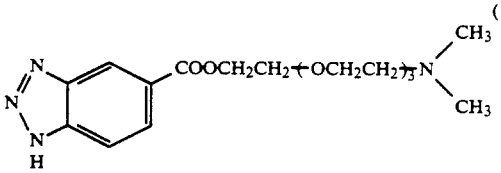

(2)

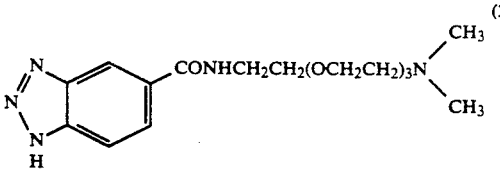

(3)

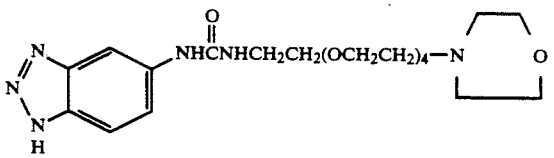

(4)

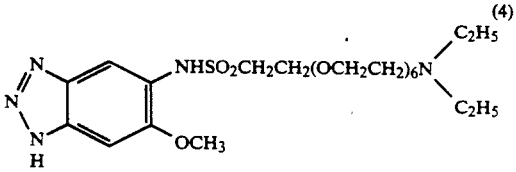

-continued
(5)
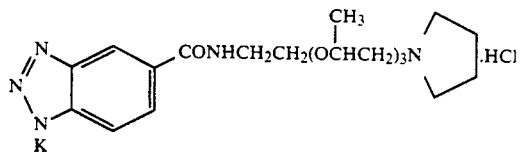
(6)
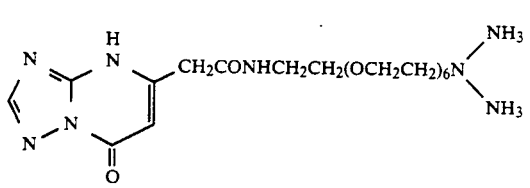
(7)
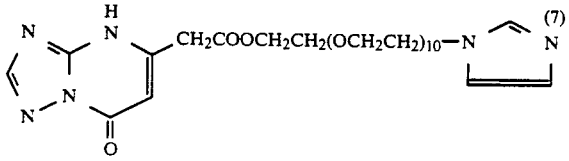
(8)
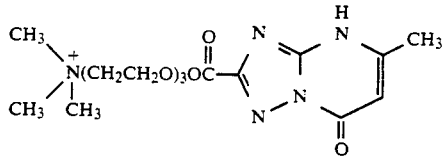
(9)
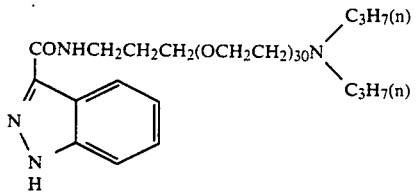
(10)
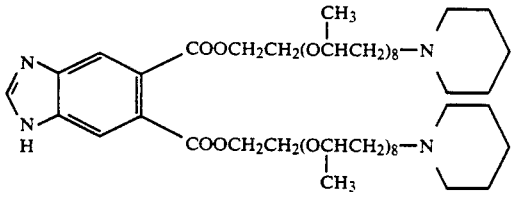
(11)
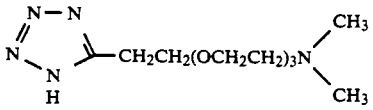
(12)
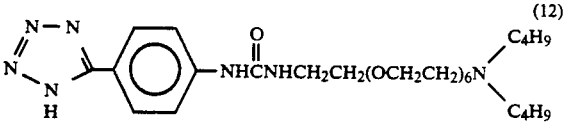
(13)
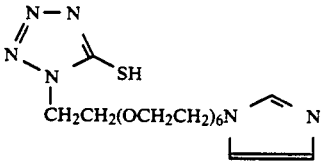
-continued
(14)
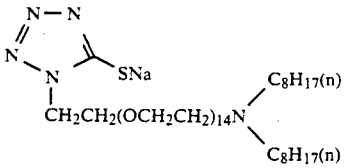
(15)
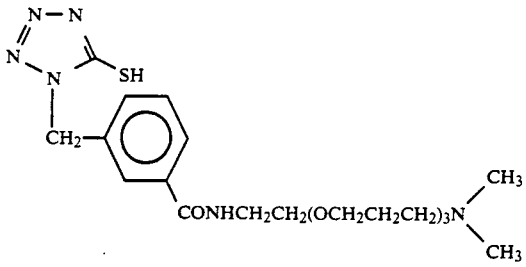
(16)
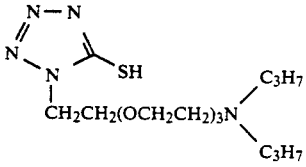
(17)
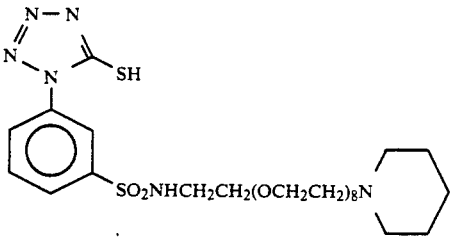
(18)
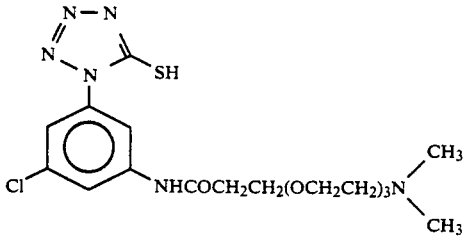
(19)
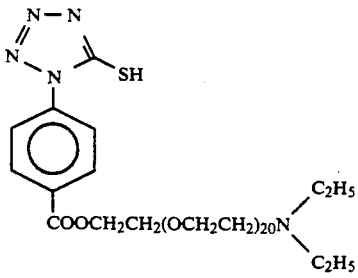
(20)
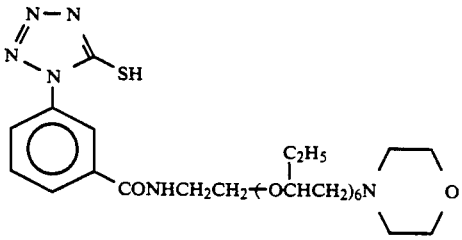

-continued
(21)
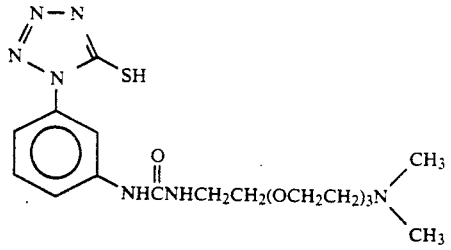
(22)
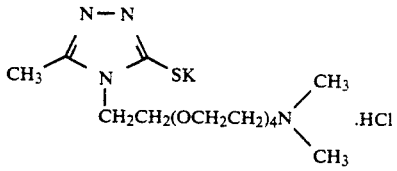
(23)
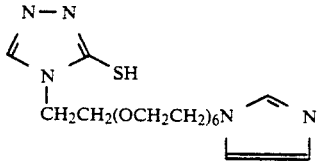
(24)
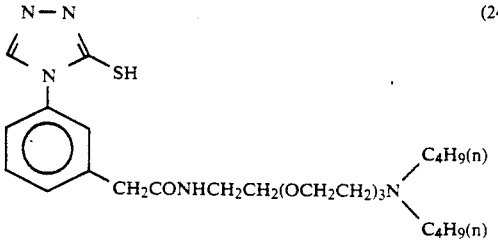
(25)
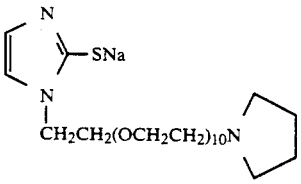
(26)
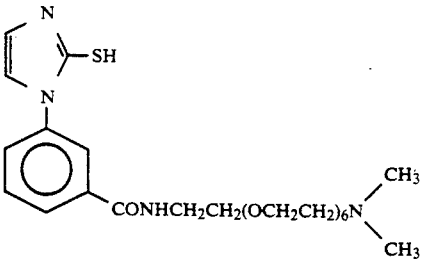
(27)
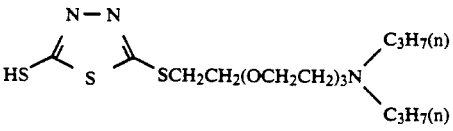
(28)
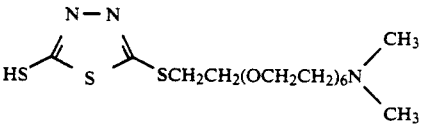
-continued
(29)
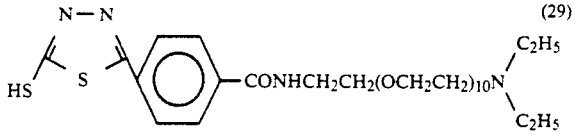
(30)
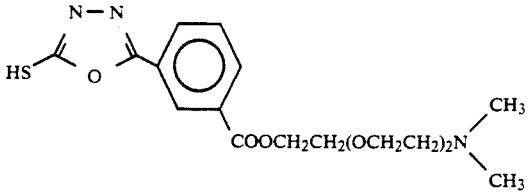
(31)
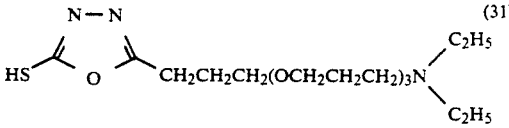
(32)
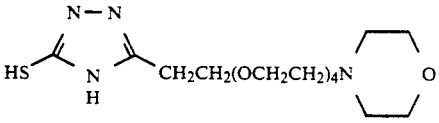
(33)
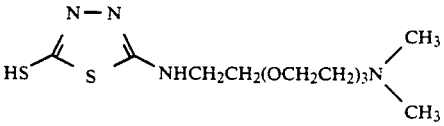
(34)
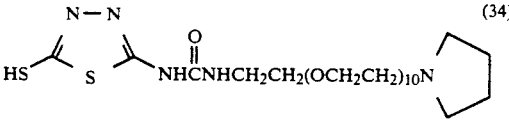
(35)
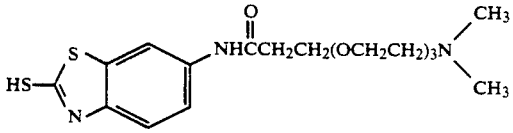
(36)
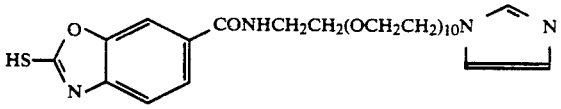
(37)
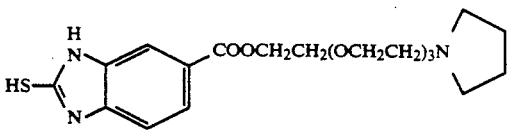
(38)
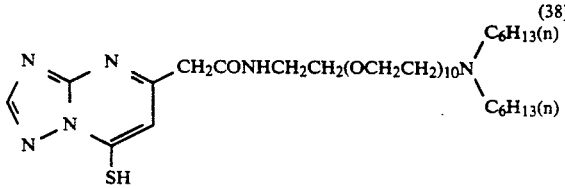

-continued (39)

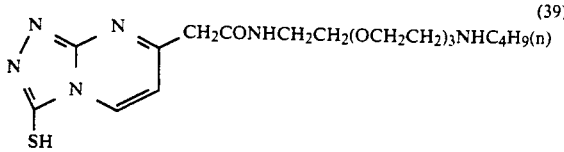

(40)

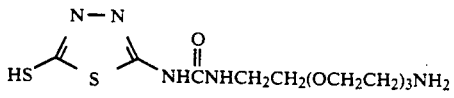

(41)

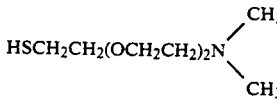

Compounds represented by general formula (I) can be prepared using the methods disclosed in *Berichte der Deutschen Chemischen Gesellschaft,* 28, 77 (1895), JP-A-50-37436, JP-A-51-3231, U.S. Pat. Nos. 3,295,976 and 3,376,310, *Berichte der Deutschen Chemischen Gesellschaft,* 22, 568 (1889), ibid, 29, 2483 (1896), *J. Chem. Soc,* 1932, 1806, *J. Am. Chem. Soc.,* 71, 4000 (1949), U.S. Pat. Nos. 2,585,388 and 2,541,924, *Advances in Heterocyclic Chemistry* 9, 165 (1968), *Organic Synthesis,* IV, 569 (1963), *J. Am. Chem. Soc.,* 45, 2390 (1923), Chemische Berichte, 9, 465 (1876), JP-B-40-28496, JP-A-50-89034, U.S. Pat. Nos. 3,106,467, 3,420,670, 2,271,229, 3,137,578, 3,148,066, 3,511,663, 3,060,028, 3,271,154, 3,251,691, 3,598,599 and 3,148,066, JP-B-43-4135, U.S. Pat. Nos. 3,615,616, 3,420,664, 3,071,465, 2,444,605, 2,444,606, 2,444,607 and 2,935,404, JP-A-57-202,531, JP-A-57-167023, JP-A-57-164735, JP-A-60-80839, JP-A-58-152235, JP-A-57-14836, JP-A-59-162546, JP-A-60-130731, JP-A-60-138548, JP-A-58-83852, JP-A-58-159529, JP-A-59-159162, JP-A-60-217358, JP-A-61-80238, JP-B-60-29390, JP-B-60-29391, JP-B-60-133061 and JP-B-61-1431. (The term "JP-B" as used herein signifies an "examined Japanese patent publication".)

The compounds of general formula (I) of the present invention, when added to light-sensitive material, are preferably added to the silver halide emulsion layer. The amount to be added to the material is from $1.0\times10^{-4}$ to $1.0\times10^{-1}$ mol, and preferably from $5.0\times10^{-4}$ to $1.0\times10^{-2}$ mol, per mol of silver halide.

In those cases where the compounds of general formula (I) of the present invention are added to the developer, they are preferably added in an amount of from 0.005 to 0.30 mol per liter of developer.

The compounds represented by general formula (I) of the present invention have the effect of promoting high contrast when used in a system by which so-called high contrast silver images are obtained.

The compounds represented by general formula (I) of the present invention are most effective when used in a system in which a hydrazine derivative is used as a nucleating agent.

The hydrazine derivatives used in the present invention are preferably compounds which can be represented by general formula (II) indicated below:

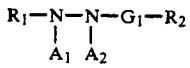

(II)

In this formula, $R_1$ represents an aliphatic group or an aromatic group; $R_2$ represents a hydrogen atom, an alkyl group, an aryl group, an alkoxy group, an aryloxy group, an amino group or a hydrazino group; $G_1$ represents a

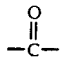

group, an $-SO_2-$ group, an $-SO-$ group, a

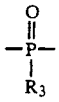

group, a

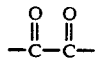

group, a thiocarbonyl group or an iminomethylene group; and $A_1$ and $A_2$ both represent hydrogen atoms, or one represents a hydrogen atom and the other represents a substituted or unsubstituted alkylsulfonyl group, or a substituted or unsubstituted arylsulfonyl group, or a substituted or unsubstituted acyl group. $R_3$ is selected from among the same groups which define $R_2$, and it may be different from $R_2$.

The aliphatic groups represented by $R_1$ in general formula (II) preferably have from 1 to 30 carbon atoms, and they are most desirably linear chain, branched or cyclic alkyl groups which have from 1 to 20 carbon atoms. The alkyl groups may be substituted with substituent groups.

The aromatic groups represented by $R_1$ in general formula (II) are single ring or double ring aryl groups or unsaturated heterocyclic groups. The unsaturated heterocyclic groups may be condensed with an aryl group.

Aryl groups are preferred for $R_1$, and those which contain a benzene ring are especially desirable.

The aliphatic groups and aromatic groups represented by $R_1$ may be substituted. Typical substituent groups include alkyl groups, aralkyl groups,-alkenyl groups, alkynyl groups, alkoxy groups, aryl groups, substituted amino groups, ureido groups, urethane groups, aryloxy groups, sulfamoyl groups, carbamoyl groups, alkyl or aryl thio groups, alkyl or aryl sulfonyl groups, alkyl or aryl sulfinyl groups, hydroxy groups, halogen atoms, cyano groups, sulfo groups, aryloxycarbonyl groups, acyl groups, alkoxycarbonyl groups, acyloxy groups, carboxamido groups, sulfonamido groups, carboxyl groups, phosphoric acid amido groups, diacylamino groups, imido groups, and

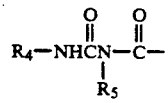

groups ($R_4$ and $R_5$ are selected from among the same groups as those defined for $R_2$). The preferred substituent groups are, for example, alkyl groups (which preferably have from 1 to 20 carbon atoms), aralkyl groups (which preferably have from 7 to 30 carbon atoms), alkoxy groups (which preferably have from 1 to 20 carbon atoms), substituted amino groups (preferably amino groups substituted with alkyl groups which have from 1 to 20 carbon atoms), acylamino groups (which preferably have from 2 to 30 carbon atoms), sulfonamido groups (which preferably have from 1 to 30 carbon atoms), ureido groups (which preferably have from 1 to 30 carbon atoms) and phosphoric acid amido groups (which preferably have from 1 to 30 carbon atoms). These groups may be further substituted.

Alkyl groups which have from 1 to 4 carbon atoms are preferred for the alkyl groups represented by $R_2$ in general formula (II), and aryl groups which have one or two rings (for example those which contain a benzene ring) are preferred for the aryl groups.

Further, alkoxy groups which have from 1 to 10, particularly 1 to 6 carbon atoms are preferred for the alkoxy groups, aryloxy groups which have from 6 to 20, particularly 6 to 12 carbon atoms are preferred for the aryloxy groups, unsubstituted amino groups and alkylamino or arylamino groups which have from 1 to 10, particularly 1 to 6 carbon atoms are preferred for the amino groups, and unsubstituted hydrazino groups and alkylhydrazino or arylhydrazino groups which have from 1 to 10 carbon atoms, particularly 1 to 6 carbon atoms are preferred for the hydrazino groups.

When $G_1$ is a

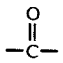

group, the preferred $R_2$ groups are, for example, hydrogen atoms, alkyl groups (for example, methyl, trifluoromethyl, 3-hydroxypropyl, 3-methanesulfonamidopropyl, phenylsulfonylmethyl), aralkyl groups (for example, o-hydroxybenzyl) and aryl groups (for example, phenyl, 3,5-dichlorophenyl, o-methanesulfonamidophenyl, 4-methanesulfonylphenyl, 2-hydroxymethylphenyl). A hydrogen atom is especially desirable.

$R_2$ may be substituted. The substituent groups cited in connection with $R_1$ can be used as substituent groups.

A

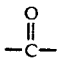

group is the most desirable group for G in general formula (II).

Furthermore, $R_2$ may be a group such that the $G_1$—$R_2$ moiety is cleaved from the rest of the molecule and a cyclization reaction occurs, forming a ring structure which contains the atoms of the —$G_1$—$R_2$ moiety, and

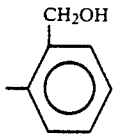

as disclosed in JP-A-63-29751, for example, can be cited as an example of this type.

$A_1$ and $A_2$ are most desirably hydrogen atoms.

The groups represented by $R_1$ or $R_2$ in general formula (II) may have incorporated within them ballast groups or polymers as generally contained in immobile photographically useful additives such as couplers. Ballast groups are groups which are comparatively inert in the photographic sense and which have at least eight carbon atoms. They can be selected, for example, from among alkyl groups, alkoxy groups, phenyl groups, alkylphenyl groups, phenoxy groups and alkylphenoxy groups. Furthermore, those disclosed, for example, in JP-A-1-100530 can be cited as such polymers.

$R_1$ or $R_2$ in general formula (II) may have incorporated within it a group which is adsorbed strongly on silver halide grain surfaces. Examples of such absorbing groups included the thiourea groups, heterocyclic thioamido groups, mercaptoheterocyclic groups and triazole groups disclosed, for example, in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246.

Examples of compounds represented by general formula (II) are indicated below, but the present invention is not limited by these compounds:

II-1

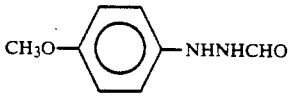

II-2

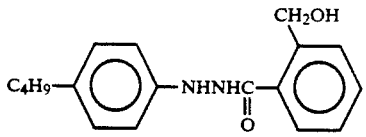

II-3

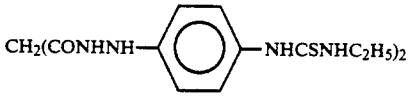

II-4

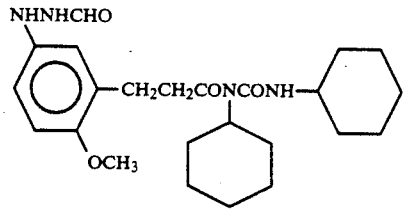

II-5

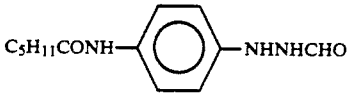

II-6

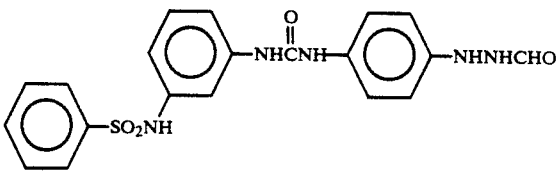

-continued
II-7
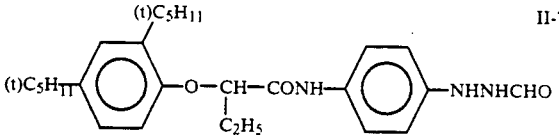
II-8
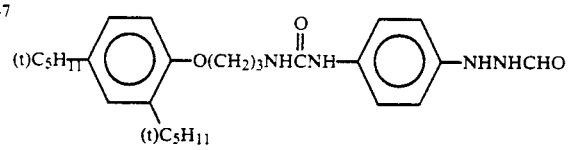
II-9
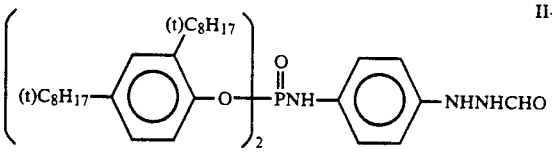
II-10
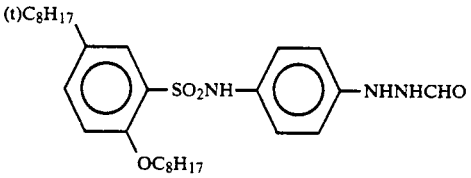
II-11
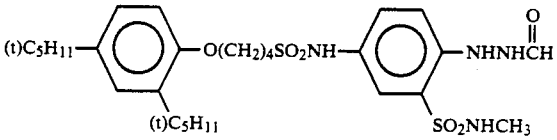
II-12
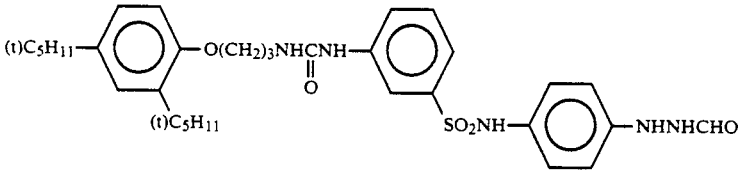
II-13
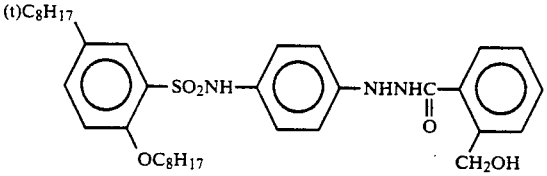
II-14
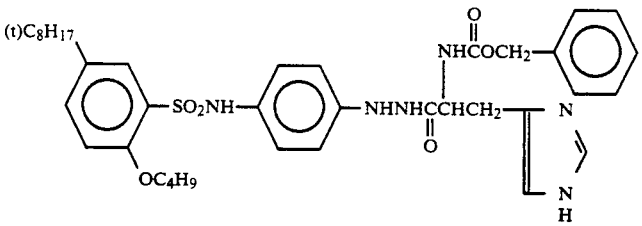
II-15
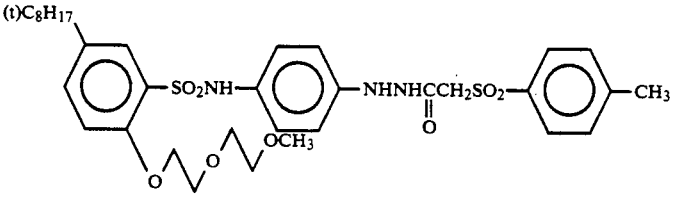
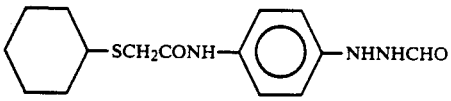
II-16
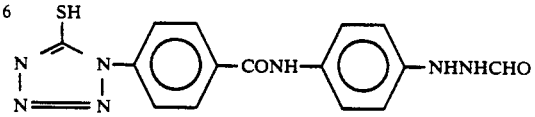
II-17

-continued
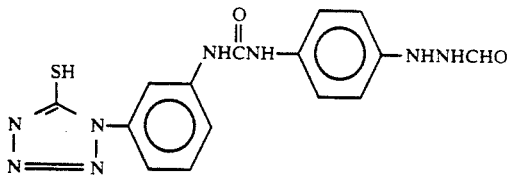
II-18
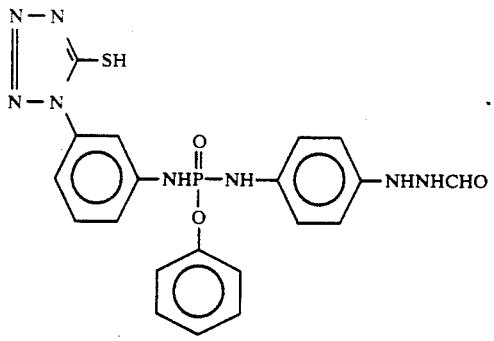
II-19
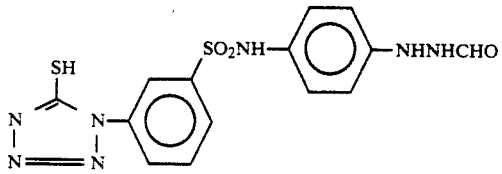
II-20
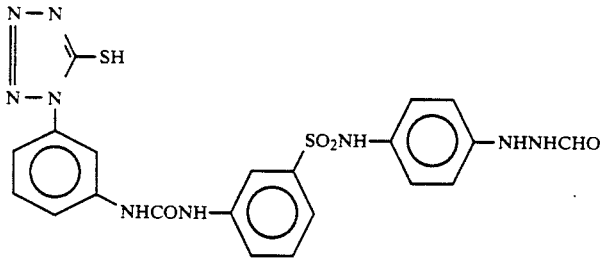
II-21
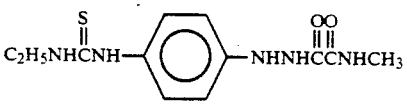
II-22
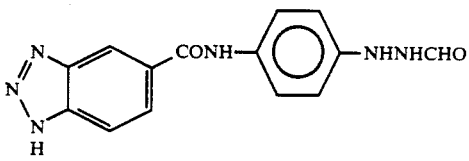
II-23
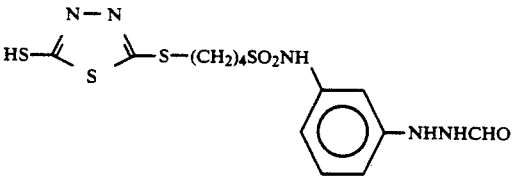
II-24
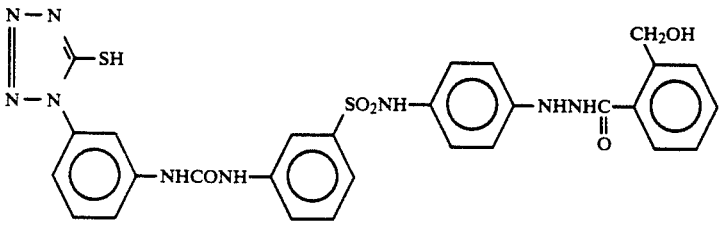
II-25

-continued

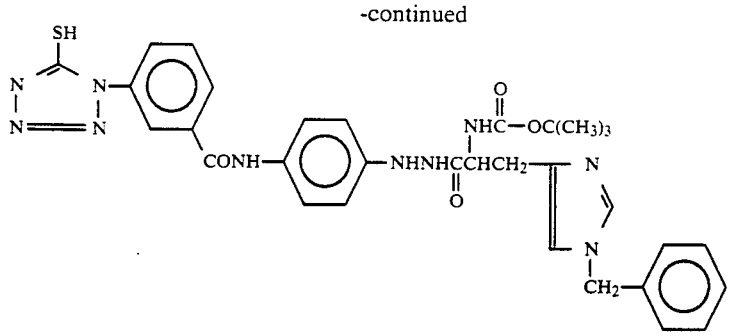

II-26

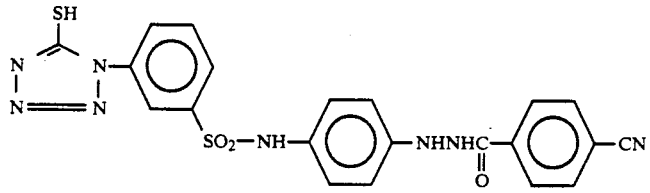

II-27

The hydrazine derivatives which can be used in the present invention include, in addition to those indicated above, those disclosed in *Research Disclosure,* Item 23516 (November 1983, page 346) and in the literature cited therein, and in U.S. Pat. Nos. 4,080,207, 4,269,929, 4,276,364, 4,278,748, 4,385,108, 4,459,347, 4,560,638 and 4,478,928, British Patent 2,011,391B, JP-A-60-179734, JP-A-62-270948, JP-A-63-29751, JP-A-61-170733, JP-A-61-270744, JP-A-62-270948, EP 217310, EP 356898, U.S. Pat. No. 4,686,167, JP-A-62-178246, JP-A-63-32538, JP-A-63-104047,JP-A-63-121838,JP-A-63-129337,JP-A-63-223744, JP-A-234244, JP-A-63-234245, JP-A-63-234246, JP-A-63-294552, JP-A-63-306438, JP-A-1-100530, JP-A-1-105941, JP-A-1-105943, JP-A-64-10233, JP-A-1-90439, JP-A-1-276128, JP-A-1-280747, JP-A-1-283548, JP-A-1-283549, JP-A-1-285940, JP-A-63-147339, JP-A-63-179760, JP-A-63-229163, JP-A-2-198440, JP-A-2-198441, JP-A-2-198442, JP-A-2-196234, JP-A-2-196235, JP-A-2-220042, JP-A-2-221953, JP-A-2-221954, JP-A-2-302750 and JP-A-2-304550.

The amount of hydrazine derivative added in the present invention is preferably from $1\times10^{-4}$ mol to $5\times10^{-2}$ mol, and most desirably from $1\times10^{-5}$ mol to $2\times10^{-2}$ mol, per mol of silver halide.

The hydrazine derivative and the compound of general formula (I) of the present invention can be dissolved in an appropriate water miscible organic solvent, such as alcohols (for example methanol, ethanol, propanol, fluorinated alcohol), ketones (for example acetone, methyl ethyl ketone), dimethylformamide, dimethylsulfoxide or methylcellosolve, for introduction into the photographic material or developer of the present invention.

Furthermore, they can be dissolved using oils such as dibutyl phthalate, tricresyl phosphate, glyceryl triacetate or diethyl phthalate and auxiliary solvents such as ethyl acetate and cyclohexanone and formed mechanically into an emulsified dispersion for use according to known methods of emulsification and dispersion. Alternatively, redox compound powders can be dispersed in water using a ball mill, a colloid mill or ultrasonically for use, according to known methods for the dispersion of a solid.

The compounds which can be represented by general formula (II') indicated below are the most desirable of hydrazine derivatives represented by general formula (II):

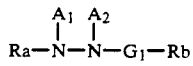

(II')

wherein $A_1$, $A_2$ and $G_1$ each has the same meaning as in general formula (II); and Ra and Rb are the same as $R_1$ and $R_2$ in general formula (I) respectively, but at least one of Ra and Rb has a group which is adsorbed on silver halide.

The silver halide emulsions used in the present invention may be of any composition, such as silver chloride, silver chlorobromide, silver iodobromide or silver iodochlorobromide for example. Silver halides of which at least 70 mol %, and most desirably at least 90 mol %, consists of silver bromide are preferred. The silver iodide content is preferably not more than 10 mol %, and most desirably from 0.1 to 5 mol %.

The average grain size of the silver halide used in the present invention is preferably very fine (for example, not more than 0.7 μm). A grain size of not more than 0.5 μm is most desirable. Fundamentally, no limitation is imposed upon the grain size distribution, but the use of mono-dispersions is preferred. The term "mono-dispersion" indicates that the emulsion is comprised of grains such that at least 95% of the grains based on the number of grains or by weight have a size within ±40% of the average grain size.

The silver halide grains in the photographic emulsion may have a regular crystalline form such as a cubic or octahedral form, or they may have an irregular crystalline form such as a spherical or plate-like form, or they may have a crystalline form which is a composite of these forms.

The silver halide grains may be such that the interior and surface layer comprise a uniform phase or they may comprise different phases. Mixtures of two or more types of silver halide emulsion which have been formed separately can also be used.

Cadmium salts, sulfite, lead salts, thallium salts, rhodium salts or complex salts thereof, and iridium salts or complex salts thereof may be present during the formation and physical ripening of the silver halide grains in the silver halide emulsions used in the present invention.

The silver halides which are especially suitable for use in the present invention are prepared in the presence of from $10^{-8}$ to $10^{-5}$ mol of iridium salt or complex salt per mol of silver. They are comprised of silver haloiodides in which the silver iodide content on the grain surface is higher than the average silver iodide content of the grain. Photographic characteristics of a higher gamma value and a higher photographic speed are obtained by using emulsions which contain silver haloiodides of this type. In this connection, it is desirable that the above mentioned quantity of iridium salt should be added before the end of the physical ripening, and especially during grain formation, during the manufacture of the silver halide emulsion.

The iridium salts are water soluble iridium salts or complex salts, for example iridium trichloride, iridium tetrachloride, hexachloroiridium(III) acid potassium salt, hexachloroiridium(IV) acid potassium salt, and hexachloroiridium(III) acid ammonium salt.

Gelatin is useful as a binding agent or protective colloid for photographic emulsions, but other hydrophilic colloids can be used for this purpose. For example, gelatin derivatives, graft polymers of other polymers with gelatin, and proteins such as albumin and casein for example; cellulose derivatives such as hydroxyethylcellulose, carboxymethylcellulose and cellulose sulfate esters for example, sodium alginate, sugar derivatives such as starch derivatives, and many synthetic hydrophilic polymer materials such as poly(vinyl alcohol), poly(vinyl alcohol) partially acetal, poly(N-vinylpyrrolidone), poly(acrylic acid), poly(methacrylic acid), polyacrylamide, polyvinylimidazole and polyvinylpyrazole, for example, either as homopolymers or as copolymers, can be used for this purpose.

Acid treated gelatin can be used as well as lime treated gelatin. Gelatin hydrolyzates and enzyme degradation products of gelatin can also be used.

The silver halide emulsions used in the method of the present invention may or may not be chemically sensitized. Sulfur sensitization, reduction sensitization and precious metal sensitization methods are known for the chemical sensitization of silver halide emulsions. Chemical sensitization can be carried out using all of these methods either individually or in combination.

Gold sensitization is typical from among the precious metal sensitization methods. Gold compounds, and principally gold complex salts, are used. Complex salts of precious metals other than gold, such as platinum, palladium and iridium for example, may be included. Examples have been disclosed in U.S. Pat. No. 2,448,060 and British Patent 618,061.

In addition to the sulfur compounds which are contained in gelatin, a variety of sulfur compounds, such as thiosulfate, thioureas, thiazoles and rhodanines for example, can be used as sulfur sensitizing agents.

Stannous salts, amines, formamidinesulfinic acid and silane compounds, for example, can be used as reduction sensitizing agents.

The sensitizing dyes (for example cyanine dyes, merocyanine dyes) disclosed on pages 45 to 53 of JP-A-55-52050 can be added to a light-sensitive material which is used in the present invention with a view to increasing photographic speed.

For example, in those cases where cationic dyes are used, cyanine dyes, hemi-cyanine dyes and rhodacyanine dyes are preferred, and the dyes indicated below are especially desirable.

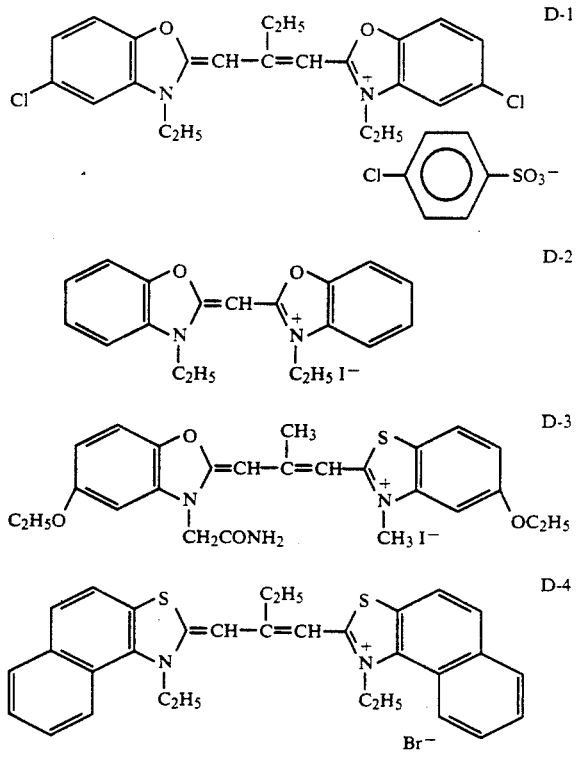

These sensitizing dyes may be used individually, but they can also be used in combinations. Combinations of sensitizing dyes are often used to achieve super-sensitization. Substances which exhibit super-sensitization, being dyes which have essentially no spectral sensitizing action themselves and substances which have essentially no absorbance in the visible region, may be included in the emulsion along with the sensitizing dyes.

Useful sensitizing dyes, combinations of dyes which exhibit super-sensitization and substances which exhibit super-sensitization have been disclosed in section IV-J on page 23 of *Research Disclosure* volume 176, number 17643 (published December, 1978).

Various compounds can be included in the light-sensitive materials of the present invention with a view to preventing the occurrence of fogging during the manufacture, storage or photographic processing of the light-sensitive material, or with a view to stabilizing photographic performance. Thus, many compounds which are known as anti-fogging agents or stabilizers, such as azoles, for example benzothiazolium salts, nitroindazoles, chlorobenzimidazoles, bromobenzimidazoles, mercaptothiazoles, mercaptobenzothiazoles, mercaptothiadiazoles, aminotriazoles, benzotriazoles and nitrobenzotriazoles; mercaptopyrimidines; merdaptotriazines, thioketo compounds such as oxazolinethione for example; azaindenes, for example triazaindenes, tetraazaindenes (especially 4-hydroxy substituted (1,3,3a,7-)tetra-azaindenes) and penta-azaindenes; benzenethiosulfonic acid, benzenesulfinic acid and benzenesulfonic acid amide, for example, can be added. From among these materials, the benzotriazoles (for example 5-methylbenzotriazole) and nitroindazoles (for example 5-nitroindazole) are preferred. Furthermore, these compounds may be included in a processing solution.

Inorganic or organic film hardening agents may be included in the photographic emulsion layers and other hydrophilic colloid layers of a photographic material of the present invention. For example, chromium salts (for example chrome alum, chromium acetate), aldehydes (for example, formaldehyde, glyoxal, glutaraldehyde), N-methylol compounds (for example, dimethylolurea, methyloldimethylhydantoin), dioxane derivatives (for example, 2,3-dihydroxydioxane), active vinyl compounds (for example, 1,3,5-triacryloyl-hexahydro-s-triazine, 1,3-vinylsulfonyl-2-propanol), active halogen compounds (for example, 2,4-dichloro-6-hydroxy-s-triazine), mucohalogen acids (for example, mucochloric acid, mucophenoxychloric acid), epoxy compounds (for example, tetramethylene glycol diglycidyl ether) and isocyanate compounds (for example, hexamethylenediisocyanate) may be used either individually or in combination.

Various surfactants can be included for various purposes in the photographic emulsion layers or other hydrophilic colloid layers of a light-sensitive material made using the present invention, for example, as coating promotors or as anti-static agents, with a view to improving slip sliding properties, for emulsification and dispersion purposes, for the prevention of sticking and for improving photographic performance (for example, accelerating development, increasing contrast or increasing photographic speed).

For example, use can be made of non-ionic surfactants, such as saponin (steroid based), alkylene oxide derivatives (for example, polyethylene glycol, polyethylene glycol/polypropylene glycol condensate, polyethylene glycol alkyl ethers or polyethylene glycol aryl alkyl ethers, polyethylene glycol esters, polyethylene glycol sorbitan esters, polyethylene glycol alkyl amines or amides and poly(ethylene oxide) adducts of silicones), glycidol derivatives (for example, alkenylsuccinic acid polyglyceride, alkylphenol polyglyceride), fatty acid esters of polyhydric alcohols and sugar alkyl esters; anionic surfactants which include acidic groups, such as carboxylic acid groups, sulfo groups, phospho groups, sulfate ester groups and phosphate ester groups, for example alkylcarboxylates, alkylsulfonates alkylbenzenesulfonates, alkylnaphthalenesulfonates, alkylsulfate esters, alkylphosphate esters, N-acyl-N-alkyltaurines, sulfosuccinateesters,sulfoalkylpolyoxyethylene alkylphenyl ethers and polyoxyethylenealkylphosphate esters; amphoteric surfactants, such as amino acids, aminoalkylsulfonic acids, aminoalkyl sulfate or phosphate esters, alkylbetaines and amine oxides; and cationic surfactants such as alkylamine salts, aliphatic and aromatic quaternary ammonium salts, heterocyclic quaternary ammonium salts, for example pyridinium salts and imidazolium salts, and phosphonium salts and sulfonium salts which contain aliphatic or heterocyclic rings.

The polyalkylene oxides having a molecular weight of at least 600 disclosed in JP-B-58-9412 are the preferred surfactants for use in the present invention. Furthermore, polymer latexes such as poly(alkyl acrylates) can be included to provide dimensional stability.

It is not necessary to use the conventional infectious developers or the highly alkaline developers of a pH approaching 13 disclosed in U.S. Pat. No. 2,419,975. Stable developers can be used to obtain photographic characteristics of high speed with superhigh contrast using a silver halide photographic material of the present invention.

That is to say, negative images of sufficiently superhigh contrast can be obtained with developers of a pH from 10.5 to 12.3, and especially of a pH from 11.0 to 12.0, which contain at least 0.15 mol/liter of sulfite ion as a preservative using silver halide photographic light-sensitive materials of the present invention.

No particular limitation is imposed upon the developing agents which can be used in the method of the present invention and, for example, dihydroxybenzenes (for example hydroquinone), 3-pyrazolidones (for example, 1-phenyl-3-pyrazolidone, 4,4-dimethyl-1-phenyl-3-pyrazolidone) and aminophenols (for example, N-methyl-p-aminophenol) can be used either individually or in combination.

The processing of silver halide light-sensitive materials of the present invention in developers which contain dihydroxybenzenes as developing agents and 3-pyrazolidones or aminophenols as auxiliary developing agents is especially desirable. In these developers, the dihydroxybenzenes are preferably used in amounts of from 0.05 to 0.5 mol/liter, along with 3-pyrazolidones or aminophenols in amounts of not more than 0.06 mol/liter.

Furthermore, the rate of development can be increased and the development time can be shortened by adding amines to the developer, as disclosed in U.S. Pat. No. 4,269,929.

The pH buffers, such as alkali metal sulfites, carbonates, borates and phosphates, and the development inhibitors and anti-foggants, such as bromide, iodide and the organic anti-foggants (of which the nitroindazoles and benzotriazoles are especially desirable), can also be included in the developer. Furthermore, hard water softening agents, dissolution aids, toning agents, development accelerators, surfactants (among which the aforementioned polyalkylene oxides are especially desirable), anti-foaming agents, film hardening agents and agents for preventing the occurrence of silver contamination of the film (for example, 2-mercaptobenzimidazolesulfonic acids) may be included as required. Commonly used compositions can be used for the fixer. Also, thiosulfate and thiocyanate, the organic sulfur compounds which are known to be effective as fixing agents, can be used for the fixing agent. Water soluble aluminum compounds, for example, can be included in the fixer as film hardening agents.

The processing temperature in the method of the present invention is generally selected from within the range from 18° C. to 50° C.

The use of an automatic processor is preferred for photographic processing, and by means of the present invention photographic characteristics with an adequate negative gradation of superhigh contrast can be obtained by setting the total processing time from entry to emergence of the light-sensitive material from the automatic processor to from 90 seconds to 120 seconds.

The present invention is described in detail by means of the illustrative non-limiting examples below.

EXAMPLE 1

An aqueous solution of silver nitrate and an aqueous solution of potassium iodide and potassium bromide were added simultaneously over a period of 60 minutes to an aqueous gelatin solution which was being maintained at 50° C. in the presence of ammonia and $4\times10^{-7}$ mol of hexachloroiridium(III) acid potassium salt per mol of silver, and by maintaining a pAg value of 7.8 during this time, a mono-disperse cubic emulsion of average grain size 0.28 μm with an average silver iodide content of 0.3 mol % was obtained. This emulsion was de-salted using a flocculation method. Then 40 grams of inert gelatin was added per mol of silver, after which the temperature was maintained at 50° C., 5,5'-dichloro-9-ethyl-3,3'-bis(3-sulfopropyl)oxacarbocyanine as a sensitizing dye and $10^{-3}$ mol per mol of silver of KI solution were added and the temperature was dropped after aging for 15 minutes.

The emulsion was re-melted, 0.02 mol/mol.Ag of methylhydroquinone, a hydrazine derivative (according to general formula (II) of the present invention), and a compound of general formula (I) and comparative compounds as nucleation accelerators were added at 40° C. as indicated in Table 1. Then 6.5 mg/m² of 5-methylbenzotriazole, 1.3 mg/m² of 6-methyl-4-hydroxyl-1,3,3a,7-tetra-azaindene, 10.0 mg/m² of Compound (a) indicated below, 0.4 g/m² of poly(ethyl acrylate) latex, and 4.0 wt % (based on gelatin) of Compound (b) indicated below as a gelatin hardening agent were added and the emulsions were coated onto a support in such a way as to provide coated silver weights of 3.4 g/m². The support had a water-proofing underlayer consisting of 0.5 μm of vinylidene chloride copolymer on a poly(ethylene terephthalate) films (thickness 150 μm).

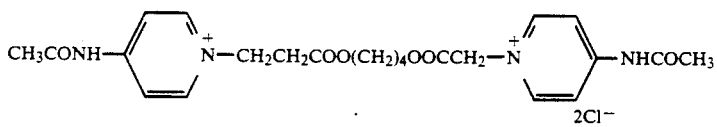

(a)

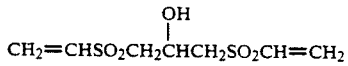

(b)

A layer containing 1.5 g/m² of gelatin, poly(methyl acrylate) (average particle size 2.5 μm) and the surfactants indicated below was coated over the top as a protective layer.

| | |
|---|---|
| 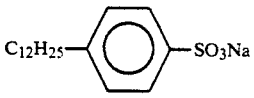 | 37 mg/m² |
| $CH_2COOC_6H_{13}$<br>\|<br>$CHCOOC_6H_{13}$<br>\|<br>$SO_3Na$ | 37 mg/m² |
| $C_8F_{17}SO_2NCH_2COOK$<br>\|<br>$C_3H_7$ | 2.5 mg/m² |

These samples were exposed through an optical wedge to tungsten light of 3200° K and then they were developed for 30 seconds at 34° C. in Developer-I, fixed for 30 seconds at 34° C. in Fuji Film GRANDEX GR-FI fixer, washed for 20 seconds at room temperature with water and dried for 1 minute with warm air. The performance obtained was as shown in Table 1.

In Table 1; the speed is the value of the exposure (log E) required to provide a density D=1.5. It is shown as a relative value with respect to Comparative Sample 1-1. The gradation (G) is the gradient of the straight line joining the points of density D=0.3 and density D=3.0 on the characteristic curve.

$D_{max}$ represents the density value at the point of low exposure, just 0.5 as a log E value from the sensitive point.

It is clear that a contrast increasing and accelerating action was observed with the addition of a small amount of the compounds of general formula (I) of the present invention. High $D_{max}$ values in particular were obtained.

Furthermore, when combinations of hydrazine compounds which had adsorbing groups, such as 2-19 and 2-26, were used as hydrazine compounds it is clear that the effect was especially pronounced.

| Developer-I | |
|---|---|
| Hydroquinone | 50.0 grams |
| N-Methyl-p-aminophenol | 0.3 gram |
| Sodium hydroxide | 18.0 grams |
| 5-Sulfosalicylic acid | 55.0 grams |
| Potassium sulfite | 110.0 grams |
| Ethylenediamine tetra-acetic acid, di-sodium salt | 1.0 gram |
| Potassium bromide | 10.0 grams |
| 5-Methylbenzotriazole | 0.4 gram |
| 2-mercaptobenzimidazole-5-sulfonic acid | 0.3 gram |
| 3-(5-mercaptotetrazole)benzenesulfonic acid, sodium salt | 0.2 gram |
| N-n-Butyldiethanolamine | 15.0 grams |
| Sodium toluenesulfonate | 8.0 grams |
| Water to make | 1 liter |
| pH adjusted to 11.4 (by adding potassium hydroxide) | |

TABLE 1

| | Sample No. | Hydrazine Derivative Type | Hydrazine Derivative Amount Added (mol/mol · Ag) | Accelerator Type | Accelerator Amount Added (mol/mol · Ag) | Photographic Properties Speed | Photographic Properties Dmax | Photographic Properties Gradation |
|---|---|---|---|---|---|---|---|---|
| 1 | Comparative 1-1 | 2-7 | $5.0 \times 10^{-4}$ | Blank | — | 0 | 2.95 | 13.1 |
| 2 | Comparative 1-2 | " | " | Comparative Compound-A | $1.0 \times 10^{-3}$ | 0.05 | 3.20 | 13.5 |
| 3 | Comparative 1-3 | " | " | " | $4.0 \times 10^{-3}$ | 0.12 | 3.35 | 15.0 |
| 4 | Comparative 1-4 | " | " | " | $10.0 \times 10^{-3}$ | 0.31 | 4.14 | 19.3 |
| 5 | Comparative 1-5 | " | " | Comparative Compound-B | $0.5 \times 10^{-3}$ | 0.33 | 4.20 | 20.1 |
| 6 | Comparative 1-6 | " | " | " | $1.0 \times 10^{-3}$ | 0.40 | 4.53 | 25.0 |
| 7 | Comparative 1-7 | " | " | " | $2.0 \times 10^{-3}$ | 0.41 | 4.67 | 27.5 |
| 8 | This Invention 1-1 | " | " | This Invention (4) | $0.5 \times 10^{-3}$ | 0.35 | 4.50 | 22.3 |
| 9 | This Invention 1-2 | " | " | " | $1.0 \times 10^{-3}$ | 0.43 | 4.88 | 27.4 |
| 10 | This Invention 1-3 | " | " | " | $2.0 \times 10^{-3}$ | 0.45 | 5.05 | 28.6 |
| 11 | This Invention 1-4 | " | " | This Invention (16) | $0.5 \times 10^{-3}$ | 0.29 | 4.42 | 20.9 |

TABLE 1-continued

| Sample No. | Hydrazine Derivative Type | Hydrazine Derivative Amount Added (mol/mol · Ag) | Accelerator Type | Accelerator Amount Added (mol/mol · Ag) | Photographic Properties Speed | Dmax | Gradation |
|---|---|---|---|---|---|---|---|
| 12 This Invention 1-5 | " | " | " | $1.0 \times 10^{-3}$ | 0.34 | 4.85 | 27.1 |
| 13 This Invention 1-6 | " | " | This Invention (19) | " | 0.38 | 4.90 | 25.0 |
| 14 This Invention 1-7 | " | " | This Invention (2) | " | 0.31 | 4.55 | 19.2 |
| 15 This Invention 1-8 | 2-7 | $5.0 \times 10^{-4}$ | This Invention (12) | $1.0 \times 10^{-3}$ | 0.30 | 4.63 | 17.4 |
| 16 This Invention 1-9 | " | " | This Invention (15) | " | 0.31 | 4.57 | 22.5 |
| 17 This Invention 1-10 | 2-19 | $1.0 \times 10^{-4}$ | This Invention (2) | " | 0.32 | 4.83 | 18.1 |
| 18 This Invention 1-11 | " | " | This Invention (4) | " | 0.33 | 5.10 | 25.3 |
| 19 This Invention 1-12 | " | " | This Invention (12) | " | 0.27 | 5.15 | 17.0 |
| 20 This Invention 1-13 | " | " | This Invention (15) | " | 0.30 | 4.98 | 20.3 |
| 21 This Invention 1-14 | " | " | This Invention (16) | " | 0.31 | 5.08 | 25.2 |
| 22 This Invention 1-15 | " | " | This Invention (19) | " | 0.35 | 5.20 | 24.6 |
| 23 This Invention 1-16 | 2-26 | $1.0 \times 10^{-4}$ | This Invention (4) | " | 0.40 | 4.91 | 20.0 |
| 24 This Invention 1-17 | " | " | This Invention (16) | " | 0.47 | 5.03 | 21.3 |
| 25 This Invention 1-18 | " | " | This Invention (19) | " | 0.45 | 5.15 | 23.4 |

Comparative Compound A
(Compound disclosed in JP-A-2-170155)

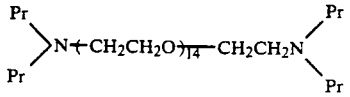

Comparative Compound B
(Compound disclosed in JP-A-63-511)

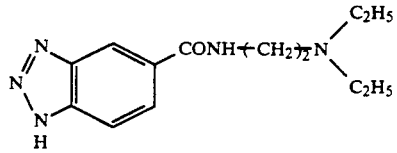

EXAMPLE 2

The silver halide photographic materials prepared in Example 1 were developed for 30 seconds at 38° C. in Developer-II and otherwise examined sensitometrically in the same way as described in Example 1.

| Developer-II | |
|---|---|
| Hydroquinone | 54 grams |
| 4-Methyl-4-hydroxymethyl-1-phenyl-3-pyrazolidone | 0.42 gram |
| Potassium sulfite | 90 grams |
| Ethylenediamine tetra-acetic acid, di-sodium salt | 2.8 grams |
| Potassium bromide | 5 grams |
| 2-mercaptobenzimidazole-5-sulfonic acid | 0.5 gram |
| Boric acid | 10 grams |
| KOH added to adjust to pH 10.6 | |
| Water to make up to | 1 liter |

The results obtained are shown in Table 2.

There was virtually no increase in contrast with the comparative samples, but it is clear that the samples of the present invention exhibited a high contrast.

High contrast was exhibited in particular with samples 1-13 to 1-18.

TABLE 2

| Sample No. | Photographic Properties Speed | $D_{max}$ | Gradation |
|---|---|---|---|
| 1 Comparative Example 1-1 | 0 | 2.15 | 5.6 |
| 2 Comparative Example 1-2 | 0.02 | 2.19 | 5.8 |
| 3 Comparative Example 1-3 | 0.05 | 2.30 | 6.1 |
| 4 Comparative Example 1-4 | 0.07 | 2.37 | 6.5 |
| 5 Comparative Example 1-5 | 0.03 | 2.25 | 5.7 |
| 6 Comparative Example 1-6 | 0.05 | 2.31 | 6.1 |
| 7 Comparative Example 1-7 | 0.07 | 2.42 | 6.6 |
| 8 Inventive Example 1-1 | 0.03 | 2.20 | 5.7 |
| 9 Inventive Example 1-2 | 0.07 | 2.35 | 8.0 |
| 10 Inventive Example 1-3 | 0.11 | 2.53 | 10.2 |
| 11 Inventive Example 1-4 | 0.05 | 2.25 | 5.9 |
| 12 Inventive Example 1-5 | 0.12 | 2.55 | 10.8 |
| 13 Inventive Example 1-6 | 0.14 | 2.61 | 11.0 |
| 14 Inventive Example 1-7 | 0.10 | 2.39 | 10.5 |
| 15 Inventive Example 1-8 | 0.10 | 2.35 | 10.3 |

TABLE 2-continued

| Sample No. | Photographic Properties Speed | $D_{max}$ | Gradation |
|---|---|---|---|
| 16 Inventive Example 1-9 | 0.10 | 2.41 | 10.5 |
| 17 Inventive Example 1-10 | 0.11 | 2.37 | 10.4 |
| 18 Inventive Example 1-11 | 0.10 | 2.40 | 10.5 |
| 19 Inventive Example 1-12 | 0.10 | 2.33 | 9.7 |
| 20 Inventive Example 1-13 | 0.24 | 4.43 | 15.9 |
| 21 Inventive Example 1-14 | 0.26 | 4.55 | 18.1 |
| 22 Inventive Example 1-15 | 0.29 | 4.58 | 17.9 |
| 23 Inventive Example 1-16 | 0.33 | 4.42 | 15.4 |
| 24 Inventive Example 1-17 | 0.39 | 4.51 | 16.0 |
| 25 Inventive Example 1-18 | 0.37 | 4.56 | 17.2 |

While the invention has been described in detail and with reference to specific embodiments thereof, it will be apparent to one skilled in the art that various changes and modifications can be made therein without departing from the spirit and scope thereof.

What is claimed is:

1. A method for processing a silver halide photographic material to form a high contrast image, wherein said silver halide photographic material comprises one or more hydrophilic colloid layers, at least one of the hydrophilic colloid layers is a silver, halide emulsion layer, which comprises developing a light-exposed silver halide photographic material in the presence of a compound represented by general formula (I):

$$Y-[(X)_n-A_0-B_0]_m \quad (I)$$

wherein Y represents a group which is adsorbed on silver halide; X represents a divalent group comprising an atom or group of atoms selected from among a hydrogen atom, a carbon atom, a nitrogen atom, an oxygen atom and a sulfur atom; $A_0$ represents a divalent linking group which has at least two alkyleneoxy units; $B_0$ represents an amino group, an ammonium group or a nitrogen containing heterocyclic group; m represents 1, 2 or 3; and n represents 0 or 1.

2. The method for processing a silver halide photographic material to form a high contrast image as in claim 1, wherein the silver halide emulsion layer or another hydrophilic colloid layer contains a hydrazine derivative represented by general formula (II):

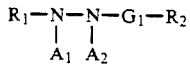

(II)

wherein $R_1$ represents an aliphatic group or an aromatic group; $R_2$ represents a hydrogen atom, an alkyl group, an aryl group, an alkoxy group, an aryloxy group, an amino group or a hydrazino group; $G_1$ represents a

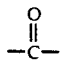

group, an $—SO_2—$ group, and —SO— group, a

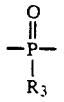

group, a

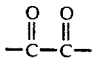

group, a thiocarbonyl group or an iminomethylene group; $A_1$ and $A_2$ both represent hydrogen atoms, or one represents a hydrogen atom and the other represents a substituted or unsubstituted alkylsulfonyl group, or a substituted or unsubstituted arylsulfonyl group, or a substituted or unsubstituted acyl group; and $R_3$ represents a hydrogen atom, an alkyl group, an aryl group, an alkoxy group, an aryloxy group, an amino group or a hydrazino group and $R_3$ may be the same or different from $R_2$.

3. The method for processing a silver halide photographic material to form a high contrast image as in claim 1, wherein the silver halide emulsion layer or another hydrophilic colloid layer contains a hydrazine derivative represented by general formula (II'):

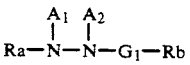

(II')

wherein $A_1$ and $A_2$ both represent hydrogen atoms or one represents a hydrogen atom and the other represents a sulfinic acid group or an acyl group; Ra represents an aliphatic group, an aromatic group or a heterocyclic group; Rb represents a hydrogen atom, an alkyl group, an aryl group, an alkoxy group, an aryloxy group or an amino group; and $G_1$ represents a carbonyl group, a sulfonyl group, a sulfoxy group, a phosphoryl group or an iminomethylene group, provided that at least one of Ra and Rb has a group which is adsorbed on silver halide.

4. The method for processing a silver halide photographic material to form a high contrast image as in claim 1, wherein said compound represented by general formula (I) is present in the silver halide emulsion layer in an amount of from $1.0\times10^{-4}$ to $1.0\times10^{-1}$ mol per mol of silver halide.

5. The method for processing a silver halide photographic material to form a high contrast image as in claim 1, wherein said compound represented by general formula (I) is present in a developer for processing the photographic material in an amount of from 0.005 to 0.30 mol per liter of developer.

6. The method for processing a silver halide photographic material to form a high contrast image as in claim 2, wherein the amount of the hydrazine derivative represented by general formula (II) is from $1\times10^{-4}$ to $5\times10^{-2}$ mol per mol of silver halide.

7. The method for processing a silver halide photographic material to form a high contrast image as in claim 3, wherein the amount of the hydrazine derivative represented by general formula (II') is from $1\times10^{-4}$ to $5\times10^{-2}$ mol per mol of silver halide.

8. A silver halide photographic material comprising a support, having thereon one or more hydrophilic colloid layers, at least one of the hydrophilic colloid layers is a silver halide emulsion layer, wherein said silver halide emulsion layer or another hydrophilic colloid layer contains a compound represented by general formula (I):

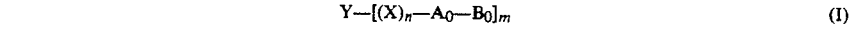

$$Y—[(X)_n—A_0—B_0]_m \quad (I)$$

wherein Y represents a group which is adsorbed on silver halide, X represents a divalent group comprising an atom or group of atoms selected from among a hydrogen atom, a carbon atom, a nitrogen atom, an oxygen atom and a sulfur atom, $A_0$ represents a divalent linking group which has at least two alkyleneoxy units, $B_0$ represents an amino group, an ammonium group or a nitrogen containing heterocyclic group, m represents 1, 2 or 3, and n represents 0 or 1.

9. The silver halide photographic material as in claim 8, wherein the silver halide emulsion layer or another hydrophilic colloid layer contains a hydrazine derivative represented by general formula (II):

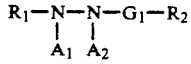

(II)

wherein $R_1$ represents an aliphatic group or an aromatic group; $R_2$ represents a hydrogen atom, an alkyl group, an aryl group, an alkoxy group, an aryloxy group, an amino group or a hydrazino group; $G_1$ represents a

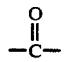

group, an $—SO_2—$ group, and —SO— group, a

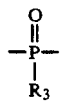

group, a

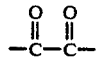

group, a thiocarbonyl group or an iminomethylene group; $A_1$ and $A_2$ both represent hydrogen atoms, or one represents a hydrogen atom and the other represents a substituted or unsubstituted alkylsulfonyl group, or a substituted or unsubstituted arylsulfonyl group, or a substituted or unsubstituted acyl group; and $R_3$ represents a hydrogen atom, an alkyl group, an aryl group, an alkoxy group, an aryloxy group, an amino group or a hydrazino group and $R_3$ may be the same or different from $R_2$.

10. The silver halide photographic material as in claim 8, wherein the silver halide emulsion layer or another hydrophilic colloid layer contains a hydrazine derivative represented by general formula (II'):

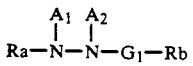

(II')

wherein $A_1$ and $A_2$ both represent hydrogen atoms or one represents a hydrogen atom and the other represents a sulfinic acid group or an acyl group; Ra represents an aliphatic group, an aromatic group or a heterocyclic group; Rb represents a hydrogen atom, an alkyl group, an aryl group, an alkoxy group, an aryloxy group or an amino group; and $G_1$ represents a carbonyl group, a sulfonyl group, a sulfoxy group, a phosphoryl group or an iminomethylene group, provided that at least one of Ra and Rb has a group which is adsorbed on silver halide.

11. The silver halide photographic material as in claim 8, wherein said compound represented by general formula (I) is present in the silver halide emulsion layer in an amount of from $1.0\times10^{-4}$ to $1.0\times10^{-1}$ mol per mol of silver halide.

12. The silver halide photographic material as in claim 8, wherein said compound represented by general formula (I) is present in a developer for processing the photographic material in an amount of from 0.005 to 0.30 mol per liter of developer.

13. The silver halide photographic material as in claim 9, wherein the amount of the hydrazine derivative represented by general formula (II) is from $1\times10^{-4}$ to $5\times10^{-2}$ mol per mol of silver halide.

14. The silver halide photographic material as in claim 10, wherein the amount of the hydrazine derivative represented by general formula (II') is from $1\times10^{-4}$ to $5\times10^{-2}$ mol per mol of silver halide.

* * * * *